US006327844B1

(12) United States Patent
Kaminske

(10) Patent No.: US 6,327,844 B1
(45) Date of Patent: Dec. 11, 2001

(54) METHODS AND APPARATUS FOR RETAINING FLOW RESTRICTORS WITHIN TURBINE ENGINES

(75) Inventor: Matthew Kaminske, Byfield, MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/517,646

(22) Filed: Mar. 3, 2000

(51) Int. Cl.[7] ..... F02C 9/18
(52) U.S. Cl. ..... 60/39.07; 29/889.22
(58) Field of Search ..... 60/39.07, 39.29; 29/889.22; 138/44; 411/479; 415/144

(56) References Cited

U.S. PATENT DOCUMENTS 2,499,315 * 2/1950 Johnson ..... 411/479
2,808,996 * 10/1957 Delfox ..... 411/479
3,972,641 * 8/1976 Harner et al. ..... 60/39.29
4,919,108 * 4/1990 Larson ..... 124/88

* cited by examiner

*Primary Examiner*—Louis J. Casaregola
(74) *Attorney, Agent, or Firm*—Andrew C. Hess; Nathan D. Herkamp

(57) ABSTRACT

A flow restrictor includes a body which permits the flow restrictor to be self-retained within a bleed port. Bleed ports are located over various portions of a gas turbine engine and extend through an engine casing. The flow restrictor body includes a bore extends between a flow restrictor body first and second ends. A slot extends between the first and second ends of the flow restrictor body. The slot further extends from an outer surface of the flow restrictor body to the bore. During assembly, the slot permits the flow restrictor to expand and conforms against the bleed port.

16 Claims, 2 Drawing Sheets

METHODS AND APPARATUS FOR RETAINING FLOW RESTRICTORS WITHIN TURBINE ENGINES

BACKGROUND OF THE INVENTION

This invention relates generally to turbine engines, and, more particularly, to turbine engines including flow restrictors.

A turbine engine typically includes a compressor assembly and a combustor assembly, each including a plurality of bleed air ports. The bleed air ports extend through a casing surrounding the compressor and combustor, and in operation, a portion of the compressed air flowing through the compressor is extracted through a bleed air supply system (BASS) attached to the bleed air ports. The bleed air may be used, for example, by an environment control system (ECS) to provide compressed air in the cabin of an aircraft or to aid in restarting an engine which has been shut down.

In known engines, flow restrictors are installed in the bleed air ports. Each flow restrictor has an internal shape similar to that of a venturi tube which restricts an amount of airflow being extracted and maintains and/or increases the pressure of the airflow exiting the bleed ports into bleed ducts. The bleed ducts channel the airflow from the bleed ports and retain the flow restrictors within the bleed ports. Over time, vibrations generated while the engine operates may cause the bleed ducts to loosen from the bleed ports resulting in a misalignment of the associated flow restrictor. Additionally, bleed ducts may be removed from bleed ports for maintenance, and the installed flow restrictors may fall from the engine and be easily damaged.

Other engines include flow restrictors which are retained within the bleed ports with intricate retaining systems. Such retaining systems permit the bleed ducts to attach to the bleed ports while permitting bleed air to pass through the flow restrictors. Such retaining systems are expensive and over time may loosen as a result of engine vibrations.

BRIEF SUMMARY OF THE INVENTION

In an exemplary embodiment, a flow restrictor includes a body which permits a flow restrictor to be self-retained within a bleed port. The bleed ports are located over various portions of a gas turbine engine and extend through an engine casing. Each bleed port includes an inner wall which defines a shape similar to that of a venturi tube including a converging portion, a throat, and a diverging portion. The flow restrictor body extends between a first and a second end, and includes a bore also extending between the first and second ends. A slot extends between the first and second ends of the flow restrictor body.

During assembly, when the slot is formed, a spring-like force is induced within the flow restrictor body causing the body to expand radially outward. The flow restrictor is circumferentially compressed and inserted within the bleed port. After the flow restrictor is inserted within the bleed port, the circumferential compression is released and the spring-like force causes the flow restrictor to expand outwardly to contact and conform to the inner walls of the bleed port. Friction between the flow restrictor and the bleed port inner walls causes the flow restrictor to be retained within the bleed port. Accordingly, when a bleed duct is attached to and/or removed from the bleed port, the flow restrictor is retained within the bleed port.

DETAILED DESCRIPTION OF THE INVENTION

Figure 1:
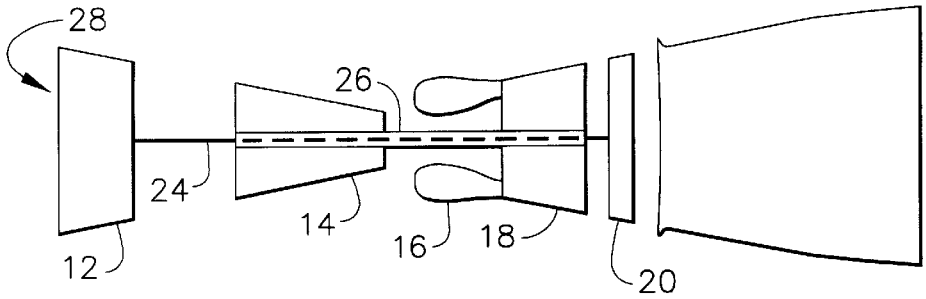
FIG. 1 is a schematic illustration of a gas turbine engine.

FIG. 1 is a schematic illustration of a gas turbine engine 10 including a low pressure compressor 12, a high pressure compressor 14, and a combustor assembly 16. Engine 10 also includes a high pressure turbine 18, and a low pressure turbine 20. Compressor 12 and turbine 20 are coupled by a first shaft 24, and compressor 14 and turbine 18 are coupled by a second shaft 26. In one embodiment, engine 10 is a CF34-8C1 engine available from General Electric Aircraft Engines, Cincinnati, Ohio.

In operation, air flows through low pressure compressor 12 from an inlet side 28 of engine 10 and compressed air is supplied from low pressure compressor 12 to high pressure compressor 14. Compressed air is then delivered to combustor assembly 16 where it is mixed with fuel an ignited. The combustion gases are channeled from combustor 16 to drive turbines 18 and 20.

Figure 2:
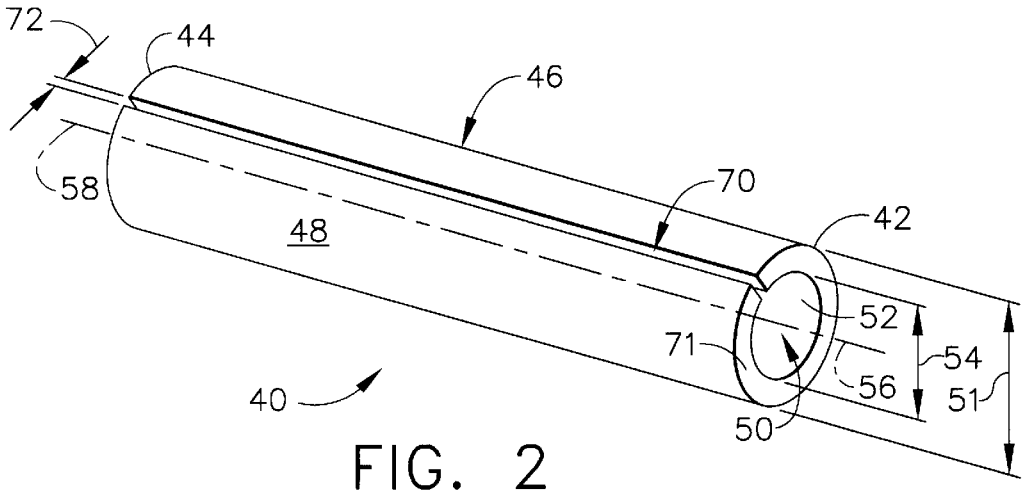
FIG. 2 is a perspective view of a flow restrictor used with the gas turbine engine shown in FIG. 1.
Figure 3:
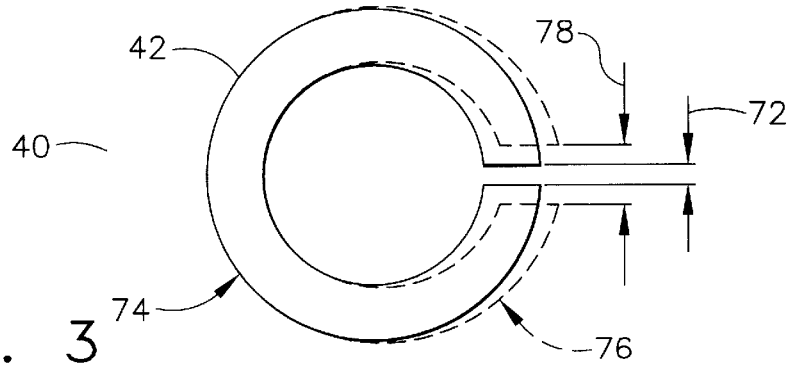
FIG. 3 is an end view of the flow restrictor shown in FIG. 2.

FIG. 2 is a perspective view of a flow restrictor 40 that may be used with gas turbine engine 10 (shown in FIG. 1) and FIG. 3 is an end view of flow restrictor 40. Flow restrictor 40 includes a first end 42, a second end 44, and a body 46 extending between first and second ends 40 and 42. Body 46 is substantially cylindrical and includes an outer surface 48 and a bore 50. A diameter 51 of body 46 is measured with respect to outer surface 48.

Bore 50 extends through body 46 from first end 42 to second end 44 and is defined by body inner surface 52 having a diameter 54. Bore 50 is concentric with flow restrictor body 46 and includes an axis of symmetry 56 that is co-linear with an axis of symmetry 58 of body 46.

Body 46 also includes a slot 70 extending from body outer surface 48 to body inner surface 54, i.e., through a wall 71 of body 46. Slot 70 has a width 72 and is substantially parallel to restrictor body axis of symmetry 58. Slot 70 extends from body first end 42 to body second end 44. At least a portion of body 46 has a substantially C-shaped cross-sectional profile. In one embodiment, slot 70 extends between body first end 42 and body second end 44, and body 46 has a substantially C-shaped cross-sectional profile.

Body 46 has an installed shape 74 formed when flow restrictor 40 is circumferentially compressed and a free state shape 76 when flow restrictor 40 is uninstalled in engine 10. When slot 70 is formed, a spring-like force is induced within flow restrictor 40 causing flow restrictor body 46 to expand radially outward. When flow restrictor 40 is compressed to installed shape 74 for installation in engine 10, slot 70 has width 72. However, when flow restrictor 40 is uninstalled and in free state shape 76, because of the spring-like force, slot 70 has a width 78 that is larger than width 72.

Figure 4:
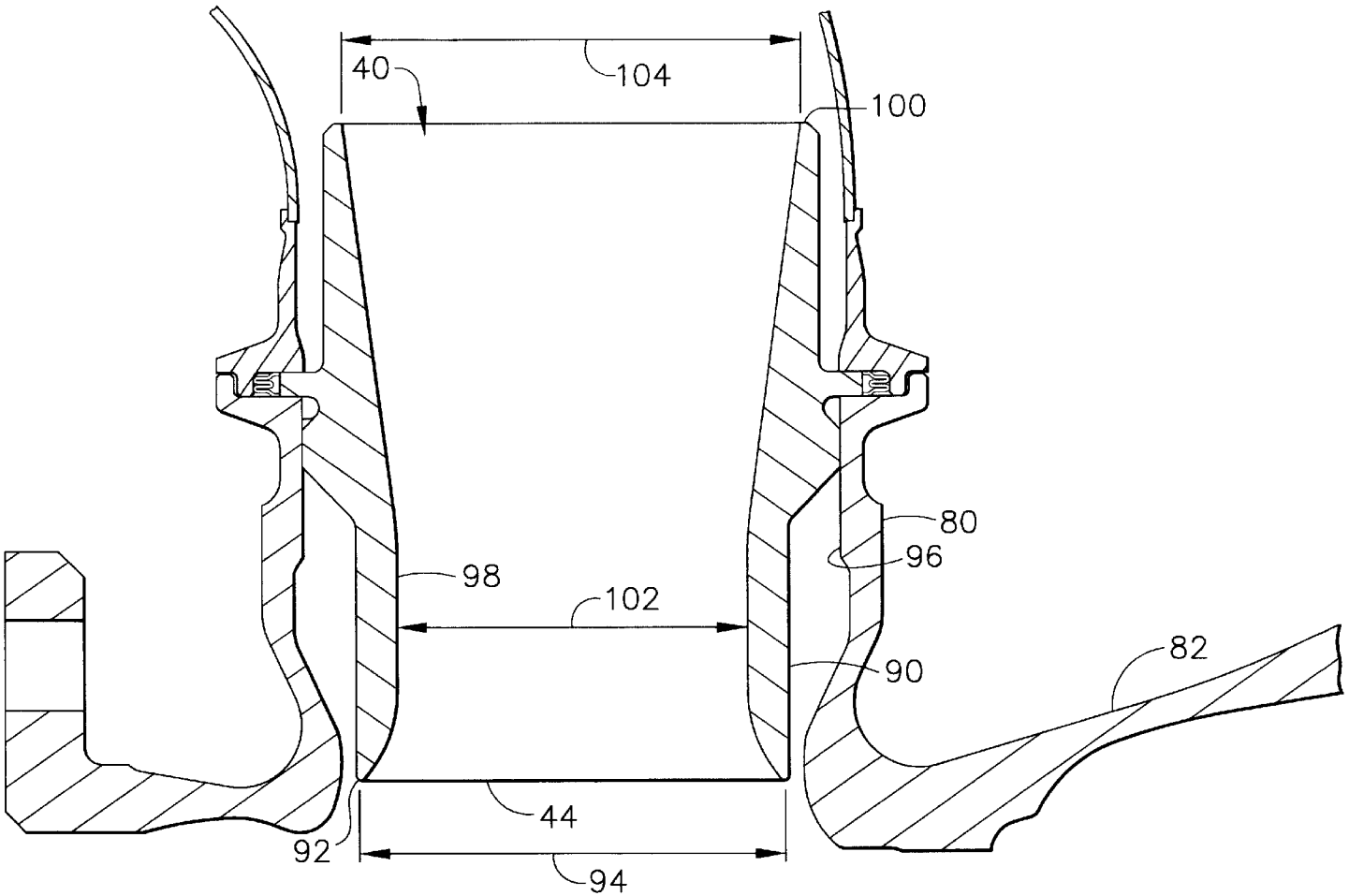
FIG. 4 is a partial cross-sectional view of the flow restrictor shown in FIG. 2 installed in the gas turbine engine shown in FIG. 1.

FIG. 4 is a partial cross-sectional view of flow restrictor 40 installed in gas turbine engine 10 (shown in FIG. 1). Gas turbine engine 10 includes a plurality of bleed ports 80 extending through an engine casing 82. Bleed ports 80 are sized to receive flow restrictors 40 and permit bleed air to be drawn from engine 10 through a plurality of bleed ducts (not shown). Bleed ports 80 may be located over various portions of engine casing 82 depending on a desired pressure of air to be bled through bleed port 80. In one embodiment, bleed ports 80 are located over engine casing 82 surrounding combustor assembly 16 (shown in FIG. 1).

Bleed ports 80 are hollow and have a cross-sectional profile similar to that of a venturi tube (not shown). Accordingly, bleed port 80 includes a body 90 having an port-side end 92 with a substantially round cross-sectional profile and a diameter 94 measured with respect to inner walls 96. Body 90 includes a throat 98 located between port-side end 92 and a duct-side end 100. Because body 90 is convergent between port-side end 92 and throat 98, throat 98 has a diameter 102 smaller than port-side end diameter 94. Body 90 is divergent between throat 98 and duct-side end 100. Accordingly, duct-side end 100 has a diameter 104 larger than throat diameter 102.

During assembly, flow restrictor 40 is initially fabricated to have a substantially cylindrical hollow shape. In one embodiment, flow restrictor 40 is fabricated from Inconel® 718. Slot 70 (shown in FIGS. 2 and 3) is formed longitudinally along outer surface 48 (shown in FIG. 2) of flow restrictor 40 and extends between flow restrictor first and second ends 42 and 44 from outer surface 48 to flow restrictor bore 50 (shown in FIG. 2). In one embodiment, flow restrictor 40 is initially forged and then machined to form slot 70.

Prior to being installed in engine bleed port 80, flow restrictor 40 is circumferentially compressed into installed shape 74 such that slot 70 has width 72 (shown in FIG. 3). Flow restrictor 40 is then inserted within bleed port 80 and the compression is released from flow restrictor 40. Because of the spring-like force induced in flow restrictor 40 when slot 70 is formed, flow restrictor 40 expands circumferentially and contacts and conforms against bleed port inner walls 96. Accordingly, flow restrictor 40 conforms to bleed port 80 such that flow restrictor inner surface 54 defines a shape similar to that of a venturi tube. The spring-like force induced within flow restrictor 40 causes flow restrictor outer surface 48 to be pressed against bleed port inner walls 96. Friction between flow restrictor outer surface 48 and bleed port inner walls 96 causes flow restrictor 40 to be retained within bleed port 80. Accordingly, when a bleed duct is attached to, and/or removed from, bleed port 80 and flow restrictor 40, flow restrictor 40 is retained within bleed port 80.

During operation, flow restrictor inner surface 54 defines a shape similar to that of a venturi tube. As airflow is extracted through bleed port 80 and flow restrictor 40, airflow is restricted by the venturi shape. Accordingly, airflow pressure is increased as airflow exits flow restrictor 40. Such an increase in pressure and a decrease in volume of the airflow, permits the airflow to exit bleed ports 80 into a bleed air supply system (BASS). In one embodiment, the airflow is used with an Environmental Control System (ECS). Alternatively, the airflow is used to cool engine 10. In yet another embodiment, the airflow is routed to aid in restarting an engine which has shut down. In a further embodiment, the airflow is routed to a deicing system.

The above-described flow restrictor is cost-effective and highly reliable. The flow restrictor is retained within a bleed port without additional hardware or fasteners. Additionally, the flow restrictor expands to conform to the shape of the bleed port, a venturi tube effect is maintained and the pressure of the airflow exiting the bleed port is recovered. Furthermore, the flow restrictor is self-retained within the bleed port and accordingly, does not include any mounting hardware or clamps which may induce stress concentrations to the engine casing. As a result, less maintenance is expended replacing failed or missing flow restrictors or associated hardware, and as such, a cost-effective and reliable flow restrictor is provided.

While the invention has been described in terms of various specific embodiments, those skilled in the art will recognize that the invention can be practiced with modification within the spirit and scope of the claims.

What is claimed is:

1. A method for assembling a gas turbine engine including bleed ports, at least one bleed port sized to receive a self-retaining flow restrictor, the flow restrictor having a body extending between a first end and a second end, the body including a bore, a slot, an inner surface, and an outer surface, the bore extending from the first end to the second end, said method comprising the steps of:

fabricating a self-retaining flow restrictor to include a slot extending from the outer surface of the slot to the bore;

inserting the self-retaining flow restrictor within the bleed port; and attaching a bleed duct to the bleed port.

2. A method in accordance with claim 1 wherein the flow restrictor body further includes an axis of symmetry extending between the body first end and the body second end, said step of fabricating a self-retaining flow restrictor further comprises the step of extending the slot from the flow restrictor body first end towards the flow restrictor body second end such that the slot is substantially parallel to the body axis of symmetry.

3. A method in accordance with claim 2 wherein said step of fabricating a self-retaining flow restrictor further comprises extending the slot from the flow restrictor body first end to the flow restrictor body second end.

4. A method in accordance with claim 3 wherein said step of inserting the self-retaining flow restrictor further comprises the step of circumferentially expanding a width of the flow restrictor slot to permit the flow restrictor body to be retained within the bleed port.

5. A method in accordance with claim 4 wherein said step of inserting the self-retaining flow restrictor further comprises the step of circumferentially compressing the flow restrictor to permit insertion into the bleed duct.

6. A gas turbine engine comprising:

an engine casing comprising a plurality of bleed ports extending therethrough, and at least one flow restrictor sized to be inserted within said bleed port, said flow restrictor configured to be retained within said bleed port and comprising a body comprising a first end, a second end, and a bore extending through said body between said first end and said second end, said body further comprising a slot and an outer surface, said slot extending from said outer surface to said bore, said slot further extending over a portion of said body from said first end towards said second end.

7. A gas turbine engine in accordance with claim 6 wherein said flow restrictor is configured to be self-retained within said bleed port.

8. A gas turbine engine in accordance with claim 7 wherein said flow restrictor body further comprises an axis of symmetry extending from said body first end to said body second end, said body bore concentric with said body, said slot substantially parallel said axis of symmetry.

9. A gas turbine engine in accordance with claim 8 wherein at least a portion of said flow restrictor body has a substantially C-shaped cross-sectional profile.

10. A gas turbine engine in accordance with claim 8 wherein said flow restrictor slot extends from said body first end to said body second end.

11. A gas turbine engine in accordance with claim 10 wherein said flow restrictor slot is configured to permit said flow restrictor body to expand.

12. A bleed port assembly for a gas turbine engine including an engine casing, said bleed port assembly comprising a bleed port extending through the engine casing and comprising at least one flow restrictor extending therein and retained within said bleed port, said flow restrictor comprising a body comprising a first end, a second end, and a bore extending therebetween through said body, said body further comprising a slot and an outer surface, said slot extending from said outer surface to said bore, and between said body first and second ends.

13. A bleed port assembly in accordance with claim 12 wherein said flow restrictor body further comprises an axis of symmetry extending from said body first end to said body second end, said flow restrictor bore concentric with said body, said flow restrictor slot substantially parallel said axis of symmetry.

14. A bleed port assembly in accordance with claim 13 wherein at least a portion of said flow restrictor body has a substantially C-shaped cross-sectional profile.

15. A bleed port assembly in accordance with claim 14 wherein said flow restrictor slot is configured to permit said body to expand to be retained within said bleed port.

16. A bleed port assembly in accordance with claim 14 wherein said flow restrictor slot extends between said body first and second ends.

* * * * *